United States Patent [19]

Terashima

[11] 4,240,375

[45] * Dec. 23, 1980

[54] APPARATUS FOR DETECTING CONCENTRATION OF TONER IN DEVELOPING POWDER

[75] Inventor: Isamu Terashima, Hitachi, Japan

[73] Assignee: Hitachi, Ltd., Japan

[ * ] Notice: The portion of the term of this patent subsequent to Dec. 26, 1995, has been disclaimed.

[21] Appl. No.: 895,373

[22] Filed: Apr. 11, 1978

[30] Foreign Application Priority Data

Apr. 13, 1977 [JP] Japan ..... 52-41429
Sept. 2, 1977 [JP] Japan .....52-104831

[51] Int. Cl.[3] ..... G03G 13/09

[52] U.S. Cl. ..... 118/689; 118/690; 355/3 DD; 430/122

[58] Field of Search ..... 118/646, 689, 690; 222/52; 355/3 DD; 430/122

[56] References Cited

U.S. PATENT DOCUMENTS

| | | | |
|---|---|---|---|
| 3,572,551 | 3/1971 | Gillespie et al. | 118/689 |
| 3,802,381 | 4/1974 | O'Neill et al. | 118/637 |
| 3,999,687 | 12/1976 | Baer et al. | 222/52 |
| 4,054,230 | 10/1977 | Suzuki et al. | 118/689 |
| 4,064,834 | 12/1977 | Sund | 118/646 |
| 4,088,092 | 5/1978 | Noguchi | 118/689 |
| 4,131,081 | 12/1978 | Tereshima | 118/646 |
| 4,147,127 | 4/1979 | Terashima | 118/646 |

FOREIGN PATENT DOCUMENTS 2747014 4/1978 Fed. Rep. of Germany ..... 355/3 DD

*Primary Examiner*—Dennis E. Talbert, Jr.
*Assistant Examiner*—John L. Goodrow
*Attorney, Agent, or Firm*—Craig & Antonelli

[57] ABSTRACT

An apparatus for detecting the concentration of toner particles contained in the developing powder is disclosed wherein the developing powder comprising a mixture of magnetic carrier particles and the toner particles is transported while being adsorbed by a magnet roll, and rubbing an electrostatic recording surface lightly to develop an electrostatic latent image. After development, the developing powder is separated from the magnet roll, flows along a guide path, and forms a magnetic path for a flat detecting coil with the flat surfaces thereof placed in the guide path in the same direction as the flow of the developing powder. In response to the magnitude of the inductance of the detecting coil, an electrical circuit produces an electrical signal corresponding to the mixing ratio between the magnetic carrier particles and the toner particles in the developing powder.

9 Claims, 8 Drawing Figures

APPARATUS FOR DETECTING CONCENTRATION OF TONER IN DEVELOPING POWDER

BACKGROUND OF THE INVENTION

1. FIELD OF THE INVENTION

This invention relates to an apparatus for detecting the concentration or mixing ratio of pigmented toner particles in the developing powder comprising a mixture or magnetic carrier particles and pigmented toner particles used with electrostatic printers or like.

2. DESCRIPTION OF THE PRIOR ART

In an apparatus wherein an electrostatic latent image is developed by the developing powder comprising a mixture of magnetic carrier particles and pigmented toner particles, the toner particles are consumed while the magnetic carrier particles remain without being consumed and are reused in the course of developing processes. After repeated use of the developing powder, the concentration of the toner particles in the developing powder gradually decreases. In order to maintain a high quality of development, the concentration of the toner particles is required to be maintained constant or in a predetermined range, which in turn requires the detection of the concentration of the toner particles. Toner concentration detecting apparatuses operated in response to variations in permeability of the developing powder were suggested. Such apparatuses include U.S. Pat. No. 3,572,551 entitled "Apparatus for Monitoring and Controlling the Concentration of Toner in a Developer Mix" invented by Henderson et al., patented Mar. 30, 1971 on application Ser. No. 811,132 filed Mar. 27, 1969, and assigned to RCA Corporation. The present inventor suggested, on the other hand, improved toner concentration detecting apparatuses in U.S. appli. Ser. No. 783,554 entitled "Toner Concentration Detecting Apparatus" invented by Isamu Terashima and filed Apr. 1, 1977, now U.S. Pat. No. 4,131,081, and in U.S. appl. Ser. No. 841,737 entitled "Toner Concentration Detecting Apparatus" invented by Isamu Terashima, filed Oct. 13, 1977, now U.S. Pat. No. 4,147,127. These inventions have the disadvantage that the flow (density) of the developing powder acting on the detecting coil is unstable or likely to be affected by an external magnetic circuit. The U.S. Pat. No. 3,802,381 entitled "Apparatus for Measuring Concentration Ratio of a Mixture of Materials" invented by Roger M. O'Neill et al., patented Apr. 9, 1974 on application Ser. No. 140,573 filed May 5, 1971 and assigned to Continental Can Company, Inc. suggests, in contrast, that the detecting coil be inserted into a detecting cylinder. Such an apparatus also poses the problem of the flow of the developing powder being disturbed by the detecting coil, thus making difficult the measurement of high accuracy. The prior art other than those cited above includes U.S. Pat. No. 3,999, 687.

SUMMARY OF THE INVENTION

Accordingly, it is an object of the present invention to provide a toner concentration detecting apparatus capable of detecting the concentration of toner particles in the developing powder at high accuracy.

Another object of the present invention is to provide a toner concentration detecting apparatus not easily affected by magnetic factors other than the developing powder.

According to the present invention, there is provided a toner concentration detecting apparatus comprising transport means, guide means for separating the developing powder from the transport means to form a laminar flow of the developing powder, and a magnetically-actuated flat element disposed in parallel to the laminer flow and embedded in the developing powder in the guide means, so that the flow of the developing powder is stable and not easily affected by external conditions due to the magnetic shield effect of the developing powder itself.

DESCRIPTION OF THE PREFERRED EMBODIMENTS

Figure 1:
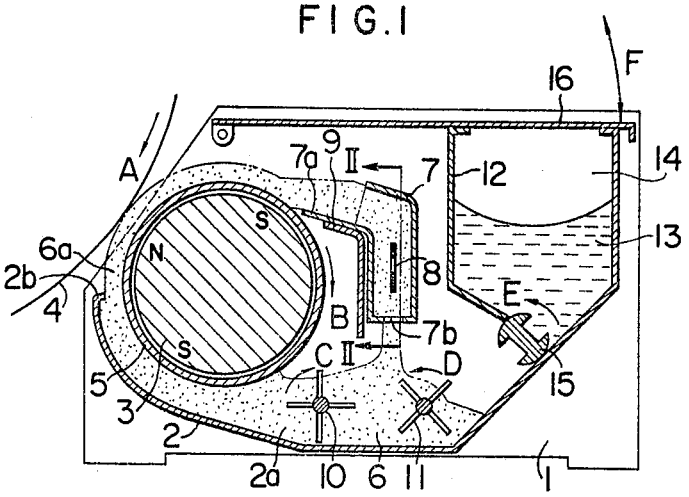
FIG. 1 is a longitudinal sectional view of the developing apparatus according to the present invention.
Figure 2:
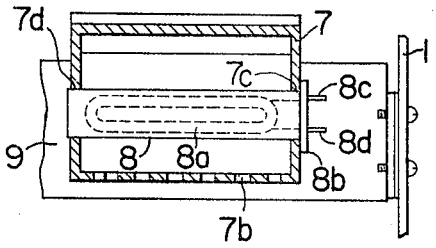
FIG. 2 is a sectional view taken in line II—II in FIG. 1.

Embodiments shown in the attached drawings will be described below. In FIGS. 1 and 2, reference numeral 1 shows two side plates in predetermined spaced relation to each other, which, holding a substantially U-shaped bottom plate 2 therebetween, forms a developer container 2*a*. Numeral 3 shows a magnet roll the outer periphery of which is magnetized to S, N, S and so on in that order. The magnet roll 3 is fixed between the side plates 1 in such a position that the magnetic pole N is opposed to an object to be developed 4 which is in motion in the direction of arrow (A). Numeral 5 shows a non-magnetic sleeve mounted rotatably on the outer periphery of the magnet roll 3 concentrically therewith. Numeral 6 shows the developing powder received on the bottom of the developing container 2*a*, and part of the developing powder 6 is adsorbed to the outer periphery of the sleeve 5 by the magnetic force of the magnet roll 3. The sleeve 5 is rotated in the direction of arrow (B) by a driving mechanism not shown, so that the developing powder adsorbed to the outer periphery of the sleeve 5 also moves in the direction of arrow (B), thereby forming a magnetic brush 6*a*. The thickness of the magnetic brush 6*a* is so limited by a doctor knife edge 2*b* provided on the bottom plate 2 that the surface of the magnetic brush 6*a* lightly rubs the surface of the object 4. Numeral 7 shows a guide cylinder for allowing the passage of the developing powder therethrough, which guide cylinder 7 has an upper opening bent toward the outer periphery of the sleeve 5. That part of the bent portion of the guide cylinder 7 which is nearer to the outer periphery of the sleeve 5 extends to a point closer to the outer periphery of the sleeve 5 than the remaining part thereof and forms a guide plate 7*a* for separating the magnetic brush 6*a* from the outer periphery of the sleeve 5 and guiding it to the upper opening of the guide cylinder 7. The lower end of the guide cylinder 7 has a bottom with a multiplicity of pores 7*b* through which the developing powder 6 in the cylinder 7 is discharged into the developer container 2*a*, thereby forming a laminar flow of the developing powder 6 which moves downward in FIG. 1 in the guide cylinder 7. At the middle part of the vertical side walls of the guide cylinder 7, coil-mounting windows 7*c* and 7*d* are formed opposedly to each other. The flat coil 8 is inserted by way of the window 7*c* and the forward end thereof is fitted into the other window 7*d*, so that the coil 8 is disposed with its surfaces parallel to the flow of the developing powder at the central part of the path in the guide cylinder 7. As shown in detail in FIGS. 2 and 8, the flat coil 8 comprises an oval spiral conductor 8*a* of thin resin (with an edge not so thin as to disturb the flow of the developing powder greatly). An end of the flat coil 8 is formed with a flange 8*b* by way of which terminals 8*c* and 8*d* are led out. Numeral 9 shows a magnetic shield plate for shielding the guide cylinder 7 from the magnetic fluxes of the magnet roll 3. The magnetic shield plate 9 is secured to the side plates 1 and the guide cylinder 7 is coupled on one side of the magnetic shield plate 9. Numerals 10 and 11 show agitators rotated in the directions of arrows (C) and (D) respectively for stirring the developing powder in the container 2*a*. Numeral 12 shows a partition plate for defining upper part of the developer container 2*a*, thereby forming a hopper 14 for storing the supply toner particles 13. At the lower end of the hopper 14 is provided a supply valve 15, which, by rotating in the direction of arrow (E), replenishes the toner particles 13. Numeral 16 shows a cover for closing the upper parts of the developer container 2*a* and the hopper 14 and mounted rotatably in the direction of arrow (F).

Figure 3:
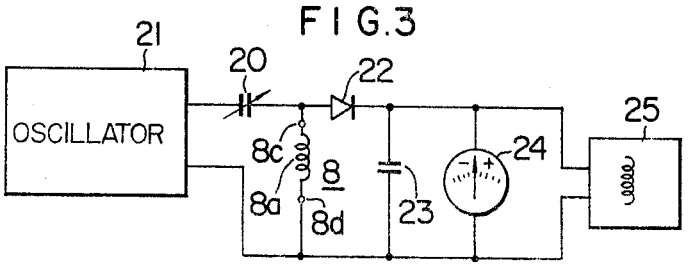
FIG. 3 shows an electrical circuit diagram.

An electrical circuit is shown in FIG. 3. The conductor 8*a* of the flat coil 8 and a variable capacitor 20 make up a series resonance circuit connected to an oscillator 21. Numeral 22 shows a diode for rectifying the terminal voltage of the coil 8, numeral 23 a smoothing capacitor for smoothing the rectified output, numeral 24 an indicator, and numeral 25 a valve control circuit for operating the supply valve 15. The indicator 24 is for indicating a shortage or excess of concentration as compared with a reference. The constants of the valve control circuit 25 are so set that when the concentration of the toner particles conforms to the reference, the resonance circuit corresponds to the intermediate part of the rising gradient of the oscillation characteristic and the indicator 24 points to the reference value. At the lower limit of the concentration of the toner particles, the valve control circuit 25 operates the valve 15 thereby to replenish the toner particles 13 in predetermined amount.

In the developing operation, the object 4, the sleeve 5, and the agitators 10 and 11 are driven synchronously in the directions of the respective arrows by a driving mechanism not shown. At the bottom of the developer container 2*a*, the developing powder 6 is adsorbed to the outer periphery of the sleeve 5 and forms the magnetic brush 6*a*, which develops the latent image in the object 4 by rubbing it lightly. Part of the magnetic brush 6*a* that has passed the developing position is separated from the surface of the sleeve 5 by the guide plate 7*a* and guided into the guide cylinder 7 from the upper opening of the guide cylinder 7. The guide cylinder 7 has vertical essential parts within it and a bottom with a multiplicity of pores 7*b*. The developing powder in the guide cylinder 7 drops onto the bottom of the developer container 2*a* through these pores 7*b*, and after being stirred by the agitators 10 and 11, is adsorbed to the sleeve 5 thus forming the magnetic brush 6*a* again.

This circulation system of the developing powder 6 includes the flat coil 8 in the guide cylinder 7. The developing powder flows downward in the form of laminar flow along both sides of the coil 8. The magnetic permeability of the developing powder, therefore, is a factor for determining the magnitude of the inductance of the flat coil 8. In the case where the concentration of toner particles is high, the permeability is low and therefore the flat coil 8 is low in inductance. With the decrease in the concentration of the toner particles, the magnetic permeability and hence the inductance of the flat coil 8 increases. As a result, the magnitude of the terminal voltage across the flat coil 8 varies, so that the indicator 24 indicates the shortage or excess of the concentration of toner particles. When the concentration of toner particles reaches the lower limit, the valve control circuit 25 is actuated to rotate the valve 15, thus replenishing the toner particles 13 into the developer container 2*a*.

Figure 4:
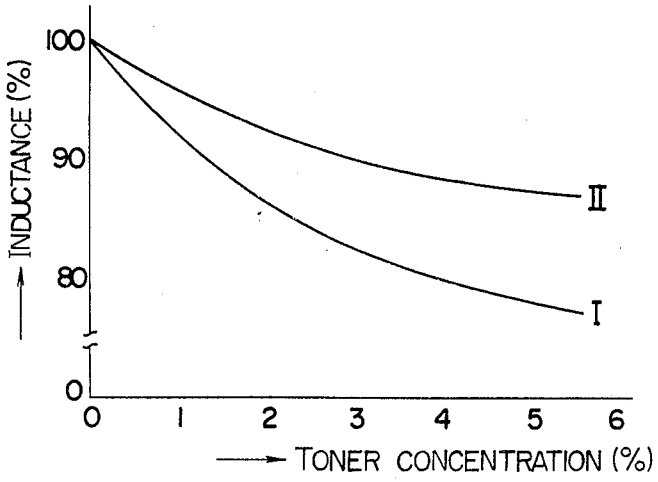
FIG. 4 is a diagram showing detection characteristics curves.

In this method of detecting the concentration of toner particles, the coil 8 is flat and embedded in the laminar flow of the developing powder, and therefore the developing powder has a great magnetic effect on the flat coil 8, with the result that the inductance of the flat coil 8 greatly varies with the magnetic permeability of the developing powder. A characteristic curve according to the embodiment under consideration is shown in the curve I of FIG. 4, while the curve II shows the characteristic for an apparatus in which the developing powder is passed through the coil. It is seen that the sensitivity to variations in the concentration of toner particles or permeability is higher in the case of curve I than curve II.

Further, since the laminer flow of the developing powder exists on both sides of the flat coil 8, the magnetic fluxes which may leak from external magnetic circuits to disturb the correct operation of the flat coil 8 can be shielded by the shield plate 9 and the laminar flow of the developing powder per se. The end of the flat coil 8 is low in resistance to the downward flow of the developing powder in the guide cylinder 7, thus minimizing the disturbance of the laminar flow (variations in the direction of flow or density of the developing powder).

Figure 5:
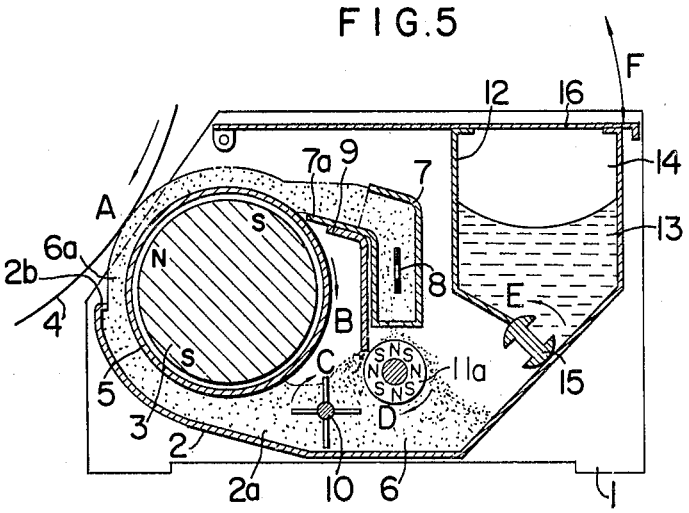
FIG. 5 is a longitudinal sectional view of the developing apparatus according to another embodiment of the present invention.

The diagram of FIG. 5 shows another embodiment of the invention wherein the mechanical agitator 11 of the developing apparatus in FIG. 1 is replaced by an agitator 11*a* of magnetic roll type. In the embodiment under consideration, the magnetic roll 11*a* is magnetized in a magnetized pattern as shown by symbols N, S, N, and so on at the outer periphery thereof in a manner similar to the magnet roll 3, and is rotated in the direction of arrow (D). Although the developing powder 6 easily leaves the vanes of the mechanical agitator 11, the developing powder adsorbed to the agitator 11*a* is not easily detached from the surface thereof. For this reason, the lower end of the magnetic shield plate 9 is located in proximity to the outer periphery of the agitator 11*a* in order to forcibly scratch off the developing powder 6 attached to the outer periphery of the agitator 11*a*. The other parts are identical to those of the configuration shown in FIG. 1.

The agitator 11*a* shown in FIG. 5 also functions to regulate the flow rate of the developing powder flowing out of the guide cylinder 7.

Figure 6:
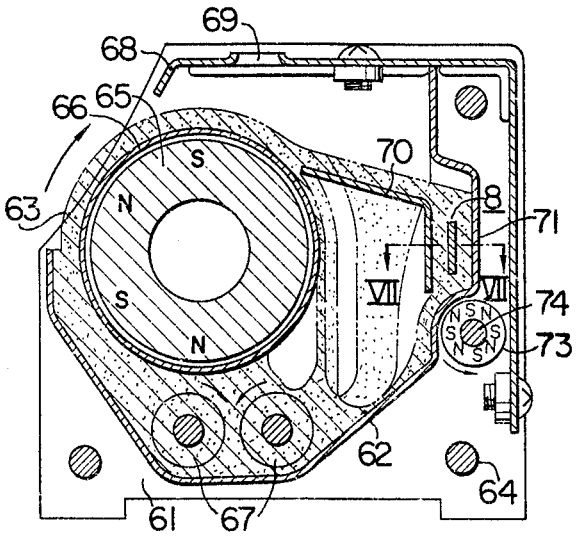
FIG. 6 is a longitudinal sectional view of the developing apparatus according to still another embodiment of the present invention.
Figure 7:
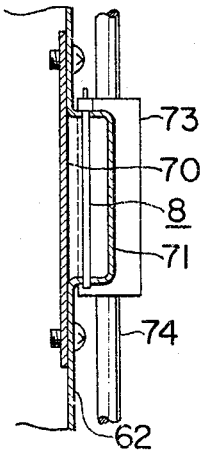
FIG. 7 is a sectional view taken in line VII—VII in FIG. 6.

Still another embodiment of the invention is illustrated in FIGS. 6 and 7. In these figures, reference numeral 61 shows side plates, numeral 62 a bottom plate, and numeral 63 the developing powder contained in the developer container made up of the side plates 61 and the bottom plate 62. Numeral 64 shows spacers to enable the assembling of the side plates 61 and the bottom plate 62 with high accuracy, numeral 65 a magnet roll secured to the side plates 61, and numeral 66 a sleeve of non-magnetic material supported on the outer periphery of the magnet roll 65 rotatably in the direction of arrow by an external driving mechanism.

Numeral 67 shows agitating screws supported on the side plates 61 rotatably in the directions of arrows respectively in operatively interlocked relation with the driving mechanism for the sleeve 66. Rotation of the agitating screws 67 agitates the developing powder on the one hand and provides frictional charges to the toner particles on the other hand.

Numeral 68 shows a cover with a toner supply port 69 at the upper part thereof. Numeral 70 shows a guide plate for guiding the developing powder on the outer periphery of the sleeve 66 into a detecting container 71 formed by extruding in recessed form the rise portion of the bottom plate 62. Part of the guide plate 70 is mounted on the bottom plate 62 to form part of the detecting container 71.

Figure 8:
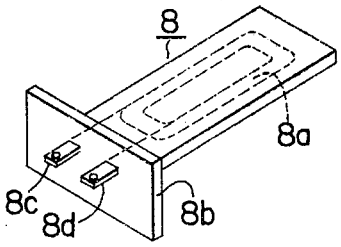
FIG. 8 is a perspective view of enlarged detecting coil.

Numeral 8 shows a detecting coil unit, which, as in FIG. 8, comprises a flatly wound detecting coil, a resin mold and terminals, and is placed within the detecting container 71.

Numeral 73 shows a compact controlling magnet in roll form and is mounted on the shaft 74 which is rotatably supported on the side plates 61 and interlocked with the driving mechanism for the sleeve 66.

In this configuration, when the sleeve 66 is rotated by an external driving mechanism in the course of development, a magnetic brush is formed on the outer periphery of the sleeve 66 and part of the developing powder 63 is introduced to the detecting container 71 by the guide plate 70. By the rotation of the controlling magnet 73 under the detecting container 71, the developing powder within the detecting container 71 is limitatively transported out into the shifting magnetic field and returned toward the bottom plate 62 forming the developer container.

In the course of other than development, neither the sleeve 66 nor the controlling magnet 73 is rotating, and therefore the lower portion of the developing powder in the detecting container 71 is restricted by the magnetic force of the controlling magnet 73 and is prevented from flowing down. As a result, the concentration of the toner particles in the developing powder is detected regardless of whether the apparatus is in the course of development or not.

In the embodiment under consideration, the bottom plate 62 and the guide plate 70, in addition to their respective own functions, double as the container for detecting the developing powder, so that the number of component elements required is reduced, thereby realizing a compact apparatus.

Also, further compactness of the apparatus is achieved by disposing the flow controlling magnet 73 in the dead space at the lower part of the detecting container 71. Furthermore, in view of the fact that the controlling magnet 73 is located outside of the developing powder container out of contact with the developing powder, the means which otherwise is required for removing the developing powder from the controlling magnet 73 making up the magnetic delivery means is eliminated on the one hand and the turning effort of the delivery means may be reduced with equal effect on the other hand.

In addition, since the controlling magnet 73 is located outside of the developing powder, the bearing means supporting the controlling magnet 73 is not exposed to the developing powder, thereby resulting in a longer service life of the bearing means.

I claim:

1. An apparatus for detecting the concentration of toner particles in the developing powder, the developing powder comprised of a mixture of magnetic carrier particles and pigmented toner particles, comprising means for containing said developing powder, means for transporting said developing powder in said container means to the surface to be developed, a hollow member, means for separating said developing powder from said transport means and for guiding said developing powder to said hollow member, and a sensor element operated in response to the magnetism of the developing powder flowing in said hollow member, said sensor element being formed flat and disposed in said hollow member in a manner that the flat surfaces of said sensor element are in parallel to the direction of flow of said developing powder moving in said hollow member.

2. An apparatus for detecting the concentration of toner particles in the developing powder according to claim 1, in which said hollow member is formed by a recess in the side wall of said container and a guide plate closing part of said recess.

3. An apparatus for detecting the concentration of toner particles in the developing powder according to claim 1, in which said sensor element includes a flat spiral coil.

4. An apparatus for detecting the concentration of toner particles in the developing powder according to claim 1, in which said sensor element is fixedly mounted by being inserted into said hollow member from a window formed in said hollow member.

5. An apparatus for detecting the concentration of toner particles in the developing powder according to claim 4, in which said sensor element comprises a flat spiral coil formed as a resin mold.

6. An apparatus for detecting the concentration of toner particles in the developing powder according to claim 1, wherein said means for transporting said developing powder in said container means to the surface to be developed includes magnet means, and further including magnetic shield means for shielding said hollow member from the magnetic fluxes of said magnet means.

7. An apparatus for detecting concentration of toner particles in the developing powder according to claim 1, wherein said means for separating said developing powder from said transport means and for guiding said developing powder to said hollow member is adapted to guide said developing powder to the top of said hollow member, whereby said developing powder flows from the top to the bottom of said hollow member, and wherein the bottom of said hollow member has a multiplicity of pores therethrough through which the developing powder flows, whereby the developing powder flows in a laminar flow through said hollow member.

8. An apparatus for detecting concentration of toner particles in the developing powder according to claim 1 or 2, further including rotatable magnetic roll means, positioned adjacent to location where said developing powder leaves said hollow member, for controlling flow of said developing powder through said hollow member.

9. An apparatus for detecting concentration of toner particles in the developing powder according to claim 8, wherein said rotatable magnetic roll means is positioned outside of said means for containing said developing powder.

* * * * *